United States Patent [19]

Gawlick et al.

[11] 3,948,179

[45] Apr. 6, 1976

[54] PRACTICE DEVICE FOR MORTARS

[75] Inventors: Heinz Gawlick; Rudolf Stahlmann, both of Furth, Bayern; Horst Rödder, Munnerstadt; Günter Mauer, Poppenlauer, all of Germany

[73] Assignees: Dynamit Nobel Aktiengesellschaft; Friedrich Wilhelm Heym, both of Germany

[22] Filed: Jan. 10, 1974

[21] Appl. No.: 432,426

[30] Foreign Application Priority Data

Apr. 12, 1973 Germany ..... 2318382

[52] U.S. Cl. ..... 102/49.1

[51] Int. Cl.[2] ..... F42B 13/20; F42B 13/22

[58] Field of Search ..... 102/41, 49.1, 49.2, 92.7; 151/24

[56] References Cited

UNITED STATES PATENTS

| | | | |
|---|---|---|---|
| 99,315 | 2/1870 | Heermance | 151/24 |
| 3,085,509 | 4/1963 | Brandt | 102/92.7 |
| 3,211,098 | 10/1965 | Stadler et al. | 102/49.1 |
| 3,374,738 | 3/1968 | Gawlick et al. | 102/49.1 |

*Primary Examiner*—Verlin R. Pendegrass

*Attorney, Agent, or Firm*—Craig & Antonelli

[57] ABSTRACT

Practice device for mortars having a central tube for receiving a subcaliber training ammunition. A locking member is firmly and detachably connected at the rear end of the tube and receives and mounts the subcaliber training ammunition therein. The tube also is arranged to receive thereabout an annular member having a lateral dimension corresponding to a predetermined mortar caliber and a nut member which is secured to the front end with the annular member being positioned between the nut member and the locking member whereby the practice device may be fired from a mortar barrel of the predetermined caliber and may be reused.

20 Claims, 4 Drawing Figures

PRACTICE DEVICE FOR MORTARS

The present invention relates to a practice device for mortars with a central tube for receiving subcaliber training ammunition.

It is known that there are mortars and/or trench mortars of different calibers. It is necessary, in accordance with these different mortar calibers, also to construct training devices for mortars and/or trench mortars in the various calibers. It is therefore an object of the present invention to provide a maximally uniform practice device for the various mortar calibers, making it possible to employ for any mortar caliber the same subcaliber training ammunition. Moreover, it is another object of this invention to adapt the handling, as well as the shape and weight of the practice device maximally accurately to the original shell, and thus to ensure a realistic training of the operating personnel.

The practice device of the present invention includes the feature that a central tube is firmly but releasably connected at its rear end with a locking or breech element intended for receiving and fastening the training ammunition and can be adapted to any desired mortar calibers by the attachment of annular members. In this way, it is made possible that the central tube and the locking element, including the subcaliber training ammunition to be employed, are the same in all types of calibers and form a basic unit. The respective caliber type is finally provided merely by attaching corresponding parts and firmly clamping these parts, for example by a threaded connection. Advantageously, the locking element is threadedly attached to the outside at the tube end and secured by means of a threaded pin. Thus, the locking element simultaneously affords the possibility for the abutment and/or support of the annular component parts pushed over the tube, which determine the final caliber sizes.

In order to make it possible to provide a maximally simple loading of the practice device with the training ammunition and removal of the cartridge case, remaining from the fired training ammunition, from the practice device, a further feature of this invention provides that the locking element, for the attachment of the training ammunition, has recesses in the manner of a bayonet connection. In this way, the training ammunition, which advantageously has studs arranged at the cartridge case, can be locked, after being inserted into the tube, in the locking element by a brief rotation. After the firing of the training ammunition, the cartridge case, which has remained in the practice device, can then be removed from the locking element of the practice device by turning in the opposite direction. In this manner, the loading operation at the mortar barrel conducted with the practice device of this invention is definitely made entirely identical to the loading of live ammunition. Additionally, no alterations of the mortar are necessary, either.

In accordance with another feature of the invention, the annular component forming the front end of the practice device is fashioned as a nut and is screwed to the front end of the tube and secured by means of a threaded pin. This makes it possible to mount the various caliber types of the practice device in a simple manner. The attached annular members are fixed in position by the tip of the practice device which is threadedly attached. The annular members are detached from the central tube having the locking element in the same manner. With the use of appropriate materials for the individual components of the practice device of this invention, the device can be utilized for long periods of time.

These and further objects, features and advantages of the present invention will become more obvious from the following description when taken in connection with the accompanying drawings which show, for purposes of illustration only, several embodiments in accordance with the present invention, and wherein FIG. 1 shows a practice device for the caliber of 81 mm., partially in a longitudinal sectional view.

FIG. 3 shows a practice device for the caliber of 4.2 in.

Figure 1:
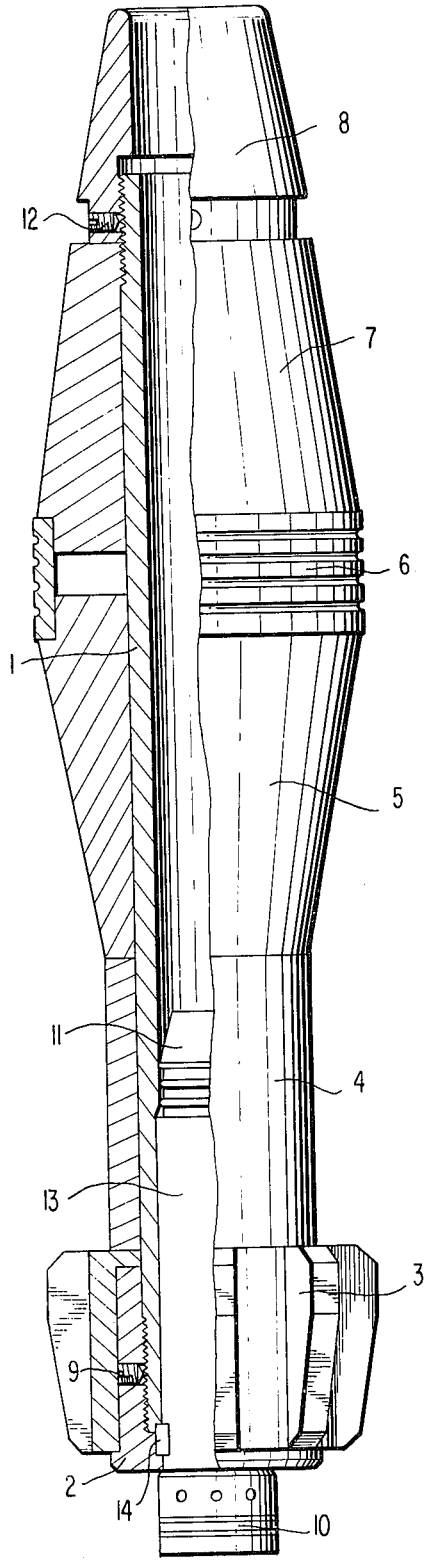

Referring now to the drawings wherein like reference numerals are utilized to designate like parts throughout the several views, there is shown in FIG. 1 the practice device of this invention illustrated in approximately two-thirds of its actual size in a design for the caliber of 81 mm. with half of the device being shown in a sectional view. A central tube 1 is threadedly connected with the locking element 2 in the manner of a screw cap and is secured against rotation by means of the threaded pin 9. A guide vane 3, an intermediate or spacer section 4, a conical or spacer member 5, a guide ring 6, and an additional conical or spacer member 7 are placed over the tube 1 having the locking element 2 secured thereto. The front end of the practice device is constituted by a nut 8 which is threaded to the front end of the tube 1 and is likewise secured against rotation by means of the further threaded pin 12. By tightening of the nut 8, the components placed on the tube 1 are secured in position. At the rear end of the tube 1 in the region of the locking element 2, the cartridge chamber is arranged to receive the subcaliber training ammunition 13. The training ammunition 13 includes a projectile 11 in a cartridge case, which is provided at the bottom side thereof with studs 14. The locking element 2 is provided with recesses fashioned as a bayonet catch, so that the training ammunition 13 is sufficiently retained in its position for practice purposes, due to the engagement of the studs 14 in the recesses after a rotational movement of the ammunition. After firing, the cartridge case can be released again by decoupling, i.e. by turning the same in the opposite direction.

The central tube 1 forms, together with the locking element 2, the basic unit of the practice device, which is identical for all mortar caliber designs, i.e. can be used for all mortar calibers. The respective caliber types are then obtained simply by the attachment of various members associated with the individual mortar calibers. The use of the same basic unit of tube 1 and locking element 2, together with the same subcaliber training ammunition, makes a simple assembly possible and provides an essentially more advantageous manufacture of the practice device than other conventional systems. The guide surfaces of the components 3 and 6 of the training device are adapted after assembly. Since, at this time, the guide components are already held and centered by the tube 1, no radial wobble at all occurs, so that a high-quality practice ammunition is obtained, which has an especially favorable effect on the dispersion.

The loading of the subcaliber training ammunition 13 in the practice device of this invention takes place similarly and at the same location as in case of live ammunition. The training ammunition is inserted in the tube 1 at the rear portion of the practice device and locked into the locking element 2 by a brief rotation to the right. This locking step can be accomplished by maximally simple measures, as already explained above, due to the at least two studs 14 mounted to the cartridge case of the training ammunition 13. The latter has, in its rear end 10, a primer and ejection charge which drives the projectile 11 of the training ammunition and the practice device, after insertion in the mortar and impingement on the fuse pin thereof, out of the mortar barrel. The ejection charge is connected with the propellant charge for the projectile 11 via a flash bore. Directly after the ignition of the ejection charge, the propellant charge of the training ammunition is ignited and drives the projectile 11 through the tube 1.

The practice device is driven out of the mortar barrel by the gases of the ejection charge, in a conventional manner, and drops to the ground several meters in front of the mortar. The cartridge case of the training ammunition, which has remained in the practice device, can now be removed by being rotated in the opposite direction; i.e. by a brief left-hand rotation, from the cartridge chamber, in other words from the locking element 2 of the practice device, and can subsequently be newly loaded again immediately for the next round. This loading procedure at the mortar barrel is entirely identical to the firing of live ammunition.

Figure 2:
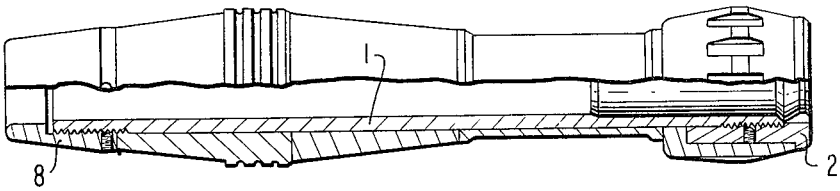
FIG. 2 shows a practice device for the smaller caliber of 60 mm.
Figure 3:
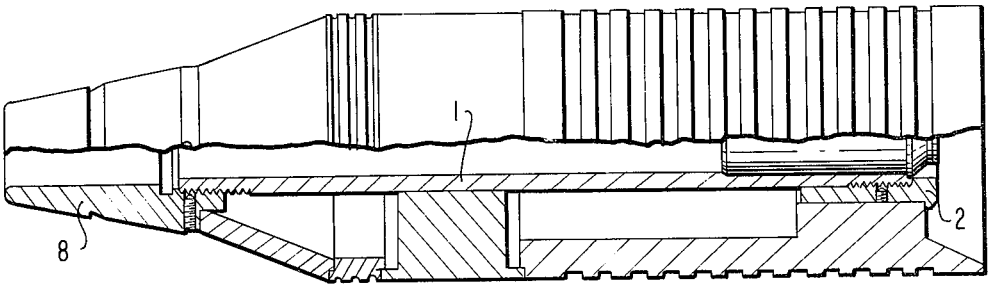
Figure 4:
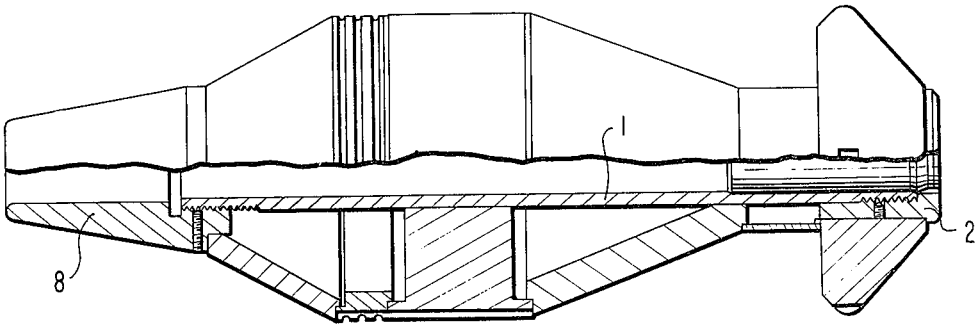
FIG. 4 shows a practice device for the large caliber of 120 mm.

The other embodiments of the practice device for other calibers, shown in FIGS. 2–4, differ from the practice device described in connection with FIG. 1, and from one another, only by the different configuration of the annular members placed over the device. The shape and dimensions of these attached components, which are not indicated in detail, result from the caliber sizes to be obtained in each particular case. However, a common aspect of all illustrated practice devices is that the basic unit of central tube 1 and locking element 2 is the same and that, moreover, also the identical subcaliber training ammunition is employed. Also the manner in which the component parts are joined to form the practice device is the same, namely by threadedly connecting the annular part 8 at the very tip, which part is fashioned as a nut.

While we have shown and described several embodiments in accordance with the present invention, it is understood that the same is not limited thereto but is susceptible of numerous changes and modifications as known to a person skilled in the art, and we therefore do not wish to be limited to the details shown and described herein but intend to cover all such changes and modifications as are obvious to one of ordinary skill in the art.

What we claim is:

1. Practice device for mortars comprising a central tube for receiving a subcaliber training ammunition therein, and locking element means being firmly and detachably connected to the rear end of the central tube, the locking element means including bore means through which the subcaliber training ammunition is inserted within the central tube and for receiving and mounting the subcaliber ammunition within the central tube, at least one annular member for detachable mounting on the central tube and having a lateral dimension corresponding to a predetermined mortar caliber such that the practice device with the subcaliber ammunition may be fired from a mortar barrel of the predetermined caliber and may be reused as a practice device.

2. Practice device according to claim 1, wherein the locking element means is threadedly connected to the exterior surface at the rear end of the central tube and further comprising threaded pin means for securing the locking means against rotation with respect to the central tube.

3. Practice device according to claim 2, wherein the locking means is a substantially annular member and extends outwardly beyond the rear end of the central tube.

4. Practice device according to claim 1, wherein the locking element means includes recess means forming a bayonet connection for receiving and fastening a corresponding bayonet connection member of the training ammunition therein.

5. Practice device according to claim 1, further comprising a first annular member in the form of a nut threadedly connected at the front end of the central tube and threaded pin means for securing the first annular member against rotation with respect to the central tube.

6. Practice device according to claim 5, further comprising a second annular member having varying lateral dimensions and being positioned on said central tube between said first annular member and said locking means, the second annular member having a lateral dimension along a portion thereof sufficient to provide a practice device corresponding to predetermined calibers of mortar ammunition.

7. Practice device according to claim 6, wherein the second annular member includes a plurality of individual separate annular sections, at least one of the sections having a lateral dimension along a portion thereof corresponding to a predetermined mortar caliber.

8. Practice device according to claim 2, further comprising a first annular member in the form of a nut threadedly connected at the front end of the central tube and threaded pin means for securing the first annular member against rotation with respect to the central tube.

9. Practice device according to claim 2, wherein the locking element means includes recess means forming a bayonet connection for receiving and fastening a corresponding bayonet connection member of the training ammunition therein.

10. Practice device according to claim 9, further comprising a first annular member in the form of a nut threadedly connected at the front end of the central tube and threaded pin means for securing the first annular member against rotation with respect to the central tube.

11. Practice device according to claim 10, further comprising a second annular member having varying lateral dimensions and being positioned on said central tube between said first annular member and said locking means, the second annular member having a lateral dimension along a portion thereof sufficient to provide a practice device corresponding to predetermined calibers of mortar ammunition.

12. Practice device according to claim 11, wherein the second annular member includes a plurality of individual separate annular sections, at least one of the sections having a lateral dimension along a portion thereof corresponding to a predetermined mortar caliber.

13. Practice device according to claim 7, wherein at least first and second annular sections have a lateral dimension corresponding to a predetermined mortar caliber, the first annular section being a rear guide element and the second annular section being a forward guide element.

14. Practice device according to claim 13, wherein the first and second annular sections are interchangeable with respective other first and second annular sections having lateral dimensions corresponding to different mortar calibers.

15. Practice device according to claim 13, wherein the first and second annular sections are spaced from one another by at least one spacer section.

16. Practice device for mortars comprising a central tube for receiving a subcaliber training ammunition therein, and locking element means being firmly and detachably connected to the rear end of the central tube, the locking element means receiving and mounting the subcaliber ammunition within the central tube, an interchangeable rear guide element and an interchangeable front guide element for detachable mounting on the central tube, each of the rear and front guide elements having a lateral dimension corresponding to a predetermined mortal caliber such that the practice device with the subcaliber ammunition may be fired from a mortar barrel of the predetermined caliber and may be used as a practice device with the rear and front guide elements being interchangeable with other respective corresponding guide elements for firing from mortar barrels of different calibers.

17. Practice device according to claim 16, further comprising a forward element in the form of a nut threadedly connected at the front end of the central tube.

18. Practice device according to claim 17, further comprising at least one spacer element disposed either between the forward element and the front guide element and between or front guide element and the rear guide element.

19. Practice device according to claim 18, wherein the rear guide element is supported toward the rear at the locking element means with the front guide element and the at least one spacer means being disposed along a portion of the length of the central tube in contact with one another and with the rear guide element and held in position by the forward element.

20. Practice device according to claim 18 wherein at least one spacer element is provided between the forward element and the front guide element and at least one spacer element is provided between the front guide element and the rear guide element.

* * * * *